US005850139A

United States Patent [19]

Edwards

[11] Patent Number: 5,850,139

[45] Date of Patent: Dec. 15, 1998

[54] LOAD POLE STABILIZED VOLTAGE REGULATOR CIRCUIT

[75] Inventor: William E. Edwards, St. Paul, Minn.

[73] Assignee: STMicroelectronics, Inc., Carrollton, Tex.

[21] Appl. No.: 808,455

[22] Filed: Feb. 28, 1997

[51] Int. Cl.[6] ..... G05F 1/56

[52] U.S. Cl. ..... 323/280; 323/282

[58] Field of Search ..... 323/273, 274, 323/275, 280, 282, 284

[56] References Cited

U.S. PATENT DOCUMENTS

| | | | |
|---|---|---|---|
| 3,946,328 | 3/1976 | Boctor | 330/109 |
| 4,349,775 | 9/1982 | Kwon et al. | 320/35 |
| 4,628,247 | 12/1986 | Rossetti | 323/314 |
| 4,908,566 | 3/1990 | Tesch | 323/280 |
| 4,912,423 | 3/1990 | Milkovic et al. | 330/255 |
| 4,954,785 | 9/1990 | Segaram | 328/167 |
| 4,970,474 | 11/1990 | Kennedy et al. | 331/2 |
| 4,972,446 | 11/1990 | Kennedy et al. | 377/47 |
| 5,124,593 | 6/1992 | Michel | 307/521 |
| 5,168,209 | 12/1992 | Thiel, V | 323/313 |
| 5,191,278 | 3/1993 | Carpenter | 323/275 |
| 5,260,644 | 11/1993 | Curtis | 323/226 |
| 5,338,977 | 8/1994 | Carobolante | 307/270 |
| 5,384,554 | 1/1995 | Abernethy | 331/153 |
| 5,521,809 | 5/1996 | Ashley et al. | 363/71 |
| 5,552,697 | 9/1996 | Chan | 323/282 |
| 5,637,992 | 6/1997 | Edwards | 323/280 |
| 5,648,718 | 7/1997 | Edwards | 323/280 |
| 5,686,821 | 11/1997 | Brokaw | 323/273 |

FOREIGN PATENT DOCUMENTS

| | | |
|---|---|---|
| 0 377 327 A2 | 7/1990 | European Pat. Off. . |
| 0 531 945 A2 | 3/1993 | European Pat. Off. . |
| 0 745 923 A2 | 12/1996 | European Pat. Off. . |
| 0 766 164 A2 | 4/1997 | European Pat. Off. . |

OTHER PUBLICATIONS

O'Malley, K., "Understanding Linear–Regulator Compensation," *Electronic Design*, vol. 42, No. 17, 22 Aug. 1994.

Williams, J. et al., La Contre–Réaction En Courant S'impose `A Fréquence Élevée, *Electronique*, No. 19, Jun. 1992, pp.68–72.

Grebene, Alan, *Bipolar and MOS Analog Integrated Circuit Design*, John Wiley & Sons, New York, New York, 1984, pp. 706–712.

*Primary Examiner*—Matthew V. Nguyen

*Attorney, Agent, or Firm*—David V. Carlson; Theodore E. Galanthay; Lisa K. Jorgenson

[57] ABSTRACT

A voltage regulator with load pole stabilization is disclosed. An error amplifier has a non-inverting input receiving a reference voltage and an inverting input receiving a feedback voltage from the output of the voltage regulator. A gain stage has an input connected to the output of the error amplifier and an output connected to a pass transistor that provides current to a load. A variable impedance device such as a FET transistor configured as a variable resistor is connected between the input and output of the gain stage to provide variable zero to cancel the varying pole when the output current drawn by the load fluctuates. Consequently, the disclosed voltage regulator has high stability without a significant increase in power dissipation.

18 Claims, 1 Drawing Sheet

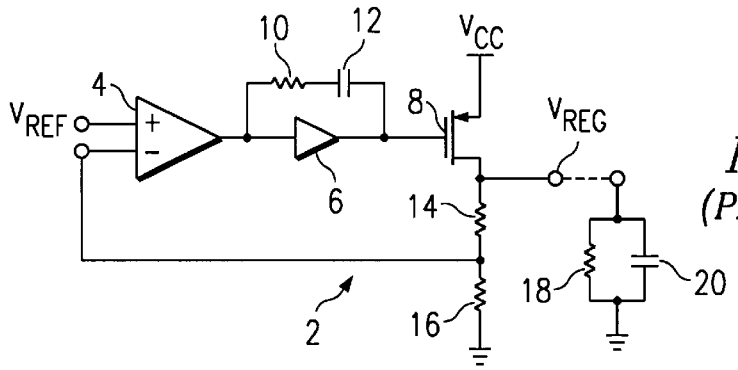
FIG. 1
(PRIOR ART)
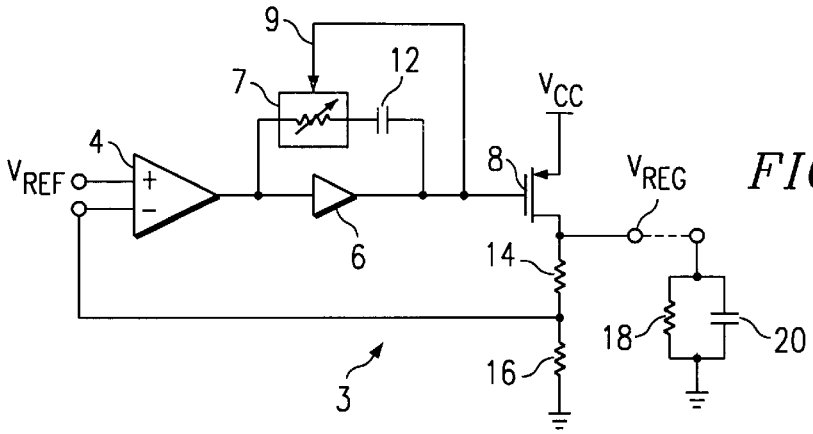
FIG. 2
FIG. 3
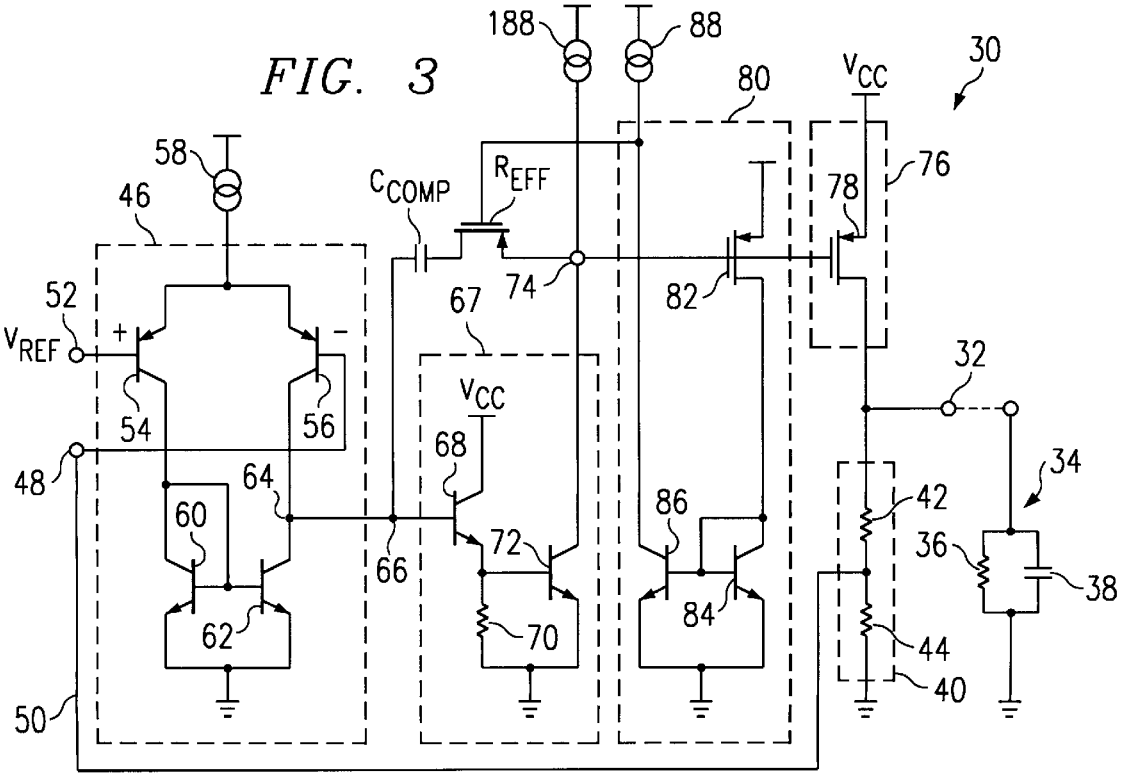

LOAD POLE STABILIZED VOLTAGE REGULATOR CIRCUIT

TECHNICAL FIELD

The present invention relates to electronic circuits used as voltage regulators and more specifically to circuits and methods for stabilizing a voltage regulator.

BACKGROUND OF THE INVENTION

The problem addressed by this invention is encountered in voltage regulation circuits. Voltage regulators are inherently medium to high gain circuits, typically greater than 50 db, with low bandwidth. With this high gain and low bandwidth, stability is often achieved by setting a dominate pole with a load capacitor. However, achieving stability over a wide range of load currents with a low value load capacitor (~0.1 uF) is difficult because the load pole formed by the load capacitor and load resistor can vary by more than three decades of frequency and be as high as tens of kHz requiring the circuit to have a very broad bandwidth of greater than 3 MHz. These broad bandwidth circuits, however, are incompatible with the power IC fabrication process used to manufacture voltage regulators.

A prior art solution to the stabilization problem is illustrated in FIG. 1. The voltage regulator 2 in FIG. 1 converts an unregulated $V_{CC}$ voltage, 12 volts in this example, into a regulated voltage $V_{REG,}$ 5 volts in this example. An amplifier 6 and capacitor 12 are configured as an integrator amplifier to set the dominant pole of the system. Resistor 10 is added to provide a zero to cancel the pole of the load (load pole). The integrator amplifier drives a pass transistor 8 that provides current to the load. A feedback network including resistors 14 and 16 form a voltage divider circuit which is used to scale the output voltage such that the output voltage can be fed back to the inverting input of an error amplifier 4. The resistor 18 and capacitor 20 are not part of the voltage regulator 2 but rather are the schematic representation of the typical load on the voltage regulator circuit.

In this prior art example, the zero associated with the voltage regulator 2 can be calculated as:

$$f_{zero} = \frac{1}{2\pi RC}$$

where R=resistance of the resistor 10 and C=capacitance of the capacitor 12; and the pole associated with the pull down resistors and load can be calculated as:

$$f_{pole} = \frac{1}{2\pi R_L C_L}$$

where $R_L$=resistance of the load=R14 and R16 in parallel with R18.

$C_L$=is the capacitance of C20 which is typically around 0.1 microfarad.

As can be seen from the above equation, the pole associated with the prior art circuit is load ($R_L$) dependent and can vary from 16 Hz to 32 kHz for an R14+R16 equal to 100 kilo-ohms and R18 ranging from 50 ohms to 1 mega-ohm. As will be appreciated by persons skilled in the art, the wide variation of the pole frequency is difficult to stabilize and may result in uncontrollable oscillation of the voltage regulator.

A prior art solution to this problem is to change the pull down resistors R14+R16 from 500 kilo-ohms to around 500 ohms which changes the pole frequency to a range of 3.2 kHz to 32 kHz, which is a frequency spread of 1 decade instead of 3 decades. However, the power dissipated by the pull down resistor R18 increases, as shown below:

$$\text{power}=(12\text{ v}-5\text{ v})\ (I_{load}+I_{pull\ down})=(7\text{ v})\ (100\text{ mA})+(7\text{ v})\ (10\text{ mA})$$

Consequently, the 500 ohm resistor adds 70 milli-watts of power dissipation in the chip which is approximately a 10% increase in power dissipation for the added stability.

Therefore, it is desirable to provide a voltage regulator with load pole stabilization without significantly increasing power dissipation. The present invention provides this and other advantages as will be illustrated by the following description and accompanying figures.

SUMMARY OF THE INVENTION

The present invention provides a voltage regulator with load pole stabilization. The voltage regulator includes an error amplifier having two inputs. The first input receives a reference voltage and the second input receives a feedback signal from the output of the voltage regulator. The error amplifier amplifies the difference between the reference voltage and the voltage of the feedback signal. A gain stage has an input connected to the output of the error amplifier and an output connected to an output stage which provides current to a load. According to the principles of the present invention, a variable impedance device such as a FET transistor whose gate is connected to the output of the gain stage is configured as a variable resistor. When the output current drawn by the load fluctuates according to the load condition thereby varying the load pole, the FET transistor varies the zero of the voltage regulator to cancel the varying load pole. Consequently, the voltage regulator according to the present invention has high stability without a significant increase in power dissipation.

BRIEF DESCRIPTION OF THE DRAWINGS

FIG. 1 is a schematic diagram of a voltage regulator according to the prior art.

FIG. 2 is a schematic diagram of a voltage regulator according to the present invention.

FIG. 3 is a detailed schematic diagram of the load pole stabilized voltage regulator of FIG. 2 according to the present invention.

DETAILED DESCRIPTION OF THE INVENTION

A load pole stabilized voltage regulator 3 according to the principles of the present invention is illustrated in FIG. 2. The load pole stabilized voltage regulator 3 is similar to the regulator 2 of FIG. 1 except that the resistor 10 is replaced with a variable impedance device 7 having an input 9 connected to the output of the gain amplifier 6. In operation, when the output current drawn by the load fluctuates according to the load condition, the load pole frequency also varies. However, the variable impedance device 7 varies the zero of the voltage regulator in a corresponding manner to cancel the varying load pole. For example, when the current drawn by the load increases, the pole frequency also increases and the regulator 3 becomes unstable. The increased load current causes the amplifier 6 to decrease its output voltage and thereby allows more current to pass through the pass transistor 8. In turn, the variable impedance device 7 receiving the decreased voltage through the input 9 decreases its resistance. The decreased resistance of the variable impedance device 7 increases the zero of the regulator 3 to cancel the increasing load pole frequency as will be explained in greater detail with reference to FIG. 3.

It is important to note, however, that while the compensation capacitor and variable impedance device 7 are shown as being connected between the input and output of the amplifier 6, the capacitor and variable impedance device can be connected anywhere in the voltage regulator so long as it provides frequency compensation (e.g., compensated to ground or pole splitting). For example, while the input 9 of the variable impedance device 7 is shown as being indirectly connected to the output of the regulator 3, the input 7 can also be directly connected to the output of the regulator. Also, while the regulator 3 as shown in FIG. 2 includes both the error amplifier 4 and the gain stage 6, persons of ordinary skill in the art will appreciate that the regulator can be designed with only the error amplifier 4 without the gain stage 6. For example, the output of the error amplifier 4 can be connected directly to the input of the output stage 8 and the resistor 10 and the compensation capacitor 12 can be connected between the output of the error amplifier 4 and the inserting input of the error amplifier 4.

Illustrated in FIG. 3 is a voltage regulator 30 according to the present invention. An output 32 of the voltage regulator 30 provides output current to a load 34 which is represented as a resistor 36 and a capacitor 38 connected in parallel with each other. A feedback network 40 connected between the output 32 and ground is shown as a voltage divider including series connected resistors 42 and 44 and outputting a divided voltage. In the embodiment shown, the resistance ratio between the resistors 42 and 44 is 4:1. Thus, in a steady load condition the divided output voltage is approximately 1 volt assuming a regulating voltage $V_{REG}$ of 5 volts.

The output of the feedback network 40 is connected to an inverting input 48 of an error amplifier 46 through a feedback path 50. A non-inverting input 52 of the error amplifier 46 is connected to a reference voltage $V_{REF}$, 1.25 volts in this example. The non-inverting and inverting inputs 52, 48 are respectively connected to the bases of a pair of differentially connected pnp transistors 54, 56. The emitters of the pnp transistors 54, 56 are connected to a current source 58 and the collectors are connected to a current mirror circuit comprising a pair of npn transistors 60, 62. Accordingly, the current flowing through the npn transistor 60 is mirrored to the npn transistor 62. The output 64 of the error amplifier 46 is connected to an input 66 of a gain stage 67.

The gain stage 67 includes a cascade connected npn transistors 68, 72 and a resistor 70 connected between the base of the npn transistor 72 and ground. The gain stage 67 is a negative gain amplifier where the higher input voltage results in lower output voltage at an output 74. The output 74 of the gain stage 67 is connected to an input of an output stage 76. In the embodiment shown, the output stage 76 is implemented as a pass element such as a PMOS transistor 78 having a source connected to a supply voltage $V_{CC}$ and a gate connected to the output 74 of the gain stage 67. The drain of the PMOS transistor 78 is connected to the feedback network 40 and the output 32 of the voltage regulator 30.

An operation of the voltage regulator 30 will now be explained with an example where the load 34 starts to draw more current from the output 32. The increased current draw by the load 34 lowers the current flowing through the feedback network 40 and its output voltage decreases. The decreased output voltage from the feedback network 40 is fed back to the inverting input 48 of the error amplifier 46 through the feedback path 50. In response, the pnp transistor 56 turns on harder and conducts more current. The extra current provided by the transistor 56 flows through the output 64. Because the constant current flowing through the transistor 60 is mirrored to the transistor 62, the npn transistor 68 of the gain stage 67 receives the extra current through its input 66. Consequently, the transistor 68 draws more current and the voltage drop across the resistor 70 increases. The increase in voltage at the base of the transistor 72 pulls down the voltage at the output 74 of the gain stage 67. Thus, the gain stage 67 is a negative gain amplifier where the increases in the input voltage results in decreases in the output voltage. The pass transistor 78 receives the lower voltage from the gain stage output 74 at its gate and allows more current to pass through, thereby increasing the voltage at the output 32. The voltage at the output 32 increases until it reaches the regulating voltage $V_{REG}$.

To achieve stability in the voltage regulator 30, a variable impedance device such as a PMOS FET transistor $R_{eff}$ and a compensation capacitor $C_{comp}$ are connected in series between the output 74 and the input 66 of the gain stage 67. The compensation capacitor $C_{comp}$, together with the PMOS transistor $R_{eff}$, which is configured as a variable resistor, vary the zero of the voltage regulator to track the varying pole of the load as will be explained below.

A sensing circuit 80 includes a PMOS transistor 82 having its gate connected to the output 74 of the gain stage 67 and its source connected to the supply voltage $V_{CC}$. The drain of the PMOS transistor 82 is connected to a current mirror comprised of two npn transistors 84, 86 having their emitters connected to ground. The collector of the transistor 86 receives current from a current source 88 and is connected to the gate input of the FET transistor $R_{eff}$. The sensing circuit 80 senses the voltage at the output 74 of the gain stage 67 and varies the gate to source voltage of the FET transistor $R_{eff}$ and thereby changing the resistance across the source and drain of the FET transistor $R_{eff}$. Specifically, the PMOS transistor 82 senses the voltage being applied to its gate and varies the current being provided to the transistors 84, 86. The size ratio of the transistors 78 and 82 as shown is approximately 100:1 so that the transistor 82 dissipates very little power. The transistor 84 mirrors the current flowing therethrough to the npn transistor 86 and the voltage at the gate of the FET transistor $R_{eff}$ is inversely proportional to the load current drawn by the load 34.

In the example given above where the current drawn by the load 34 increases, the load resistance represented by the resistor 36 decreases. Since the pole frequency is inversely proportional to the load resistance, the load pole frequency increases and as a result, the voltage regulator becomes unstable. To stabilize the regulator, the gain stage 67 together with the sensing circuit 80 increases the gate to source voltage $V_{GS}$ of the FET transistor $R_{eff}$. The FET transistor $R_{eff}$ is configured as a variable resistor whose resistance is inversely proportional to the gate to source voltage $V_{GS}$ minus the threshold voltage $V_T$. Thus, the resistance across the drain and source of the FET transistor $R_{eff}$ decreases. The decreased resistance of the FET transistor $R_{eff}$ increases the zero of the voltage regulator 30 to track the increasing pole frequency of the load 34 when more current is demanded by the load 34. Conversely, when the current drawn by the load 34 decreases, the load pole frequency decreases and the zero of the voltage regulator 30 decreases to cancel the decreasing pole frequency of the load 34. Thus, the voltage regulator according to the present invention has high stability without a significant increase in power dissipation.

While the word "connected" is used throughout the specification for clarity, it is intended to have the same meaning as "coupled." Accordingly, "connected" should be interpreted as meaning either a direct connection or an indirect connection. For example, the gate input of the FET transistor $R_{eff}$ is coupled or indirectly connected to the output 32 through the sensing circuit 80 and the PMOS transistor 78.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A voltage regulator, comprising:

an error amplifier having a first input for receiving a reference voltage, a second input, and an output;

a gain stage having an output and an input, the gain stage input being connected to the output of the error amplifier;

a compensation capacitor connected to the gain stage;

an output stage having an input connected to the output of the gain stage;

a feedback path connected between the second input of the error amplifier and the output of the output stage; and a variable impedance device having an input connected to the output of the gain stage and operable to vary the zero of the voltage regulator as the output current of the voltage regulator varies.

2. The voltage regulator of claim 1 wherein the variable impedance device includes a FET transistor.

3. The voltage regulator of claim 1, further comprising a sensing circuit having an input connected to the gain stage and an output connected to the input of the variable impedance device.

4. The voltage regulator of claim 3 wherein the sensing circuit comprises:

a sensing transistor connected to the output of the gain stage; and a current mirror connected to the sensing transistor and the input of the variable impedance device.

5. The voltage regulator of claim 1 wherein the variable impedance device and the compensation capacitor are connected in series between the input and output of the gain stage.

6. The voltage regulator of claim 1, further comprising a feedback network connected between the output stage and the feedback path.

7. The voltage regulator of claim 6 wherein the feedback network includes a voltage divider.

8. A voltage regulator to generate a regulated output voltage, comprising:

an error amplifier having a reference input to receive a reference voltage and a feedback input coupled to the regulated output voltage, the error amplifier generating an error signal indicative of a difference between said reference input and said feedback input; and a compensation circuit coupled to the error amplifier to compensate for current fluctuations in the regulated output voltage, the compensation circuit including a variable impedance device having an input coupled to the error amplifier and operable to vary a frequency zero of the voltage regulator as the current fluctuates in the regulated output voltage.

9. The voltage regulator of claim 8 wherein the variable impedance device is a FET transistor.

10. The voltage regulator of claim 8, further comprising a sensing circuit having an input and an output connected to the input of the variable impedance device.

11. The voltage regulator of claim 10 wherein the sensing circuit comprises:

a sensing transistor coupled to the regulated output voltage to sense the current drawn from the voltage regulator; and a current mirror connected to the sensing transistor and the input of the variable impedance device.

12. The voltage regulator of claim 11, further including a compensation capacitor in the compensation circuit wherein the variable impedance device and the compensation capacitor are connected in series between the input and output of the compensation circuit.

13. The voltage regulator of claim 8, further comprising a voltage divider connected between the regulated output voltage and the feedback input to divide the regulated output voltage.

14. A voltage regulator, comprising:

an error amplifier having a first input for receiving a reference voltage, a second input for receiving the regulated output voltage, and an output, the error amplifier operable to amplify the voltage difference between the first and second inputs;

an output stage having an input connected to the output of the error amplifier and an output for providing the regulated output voltage to a load;

a variable impedance device having an input connected to the output of the gain stage, the variable impedance device varying its resistance responsive to change in its input voltage to vary the zero of the voltage regulator as the output current of the voltage regulator varies; and a feedback path connected between the second input of the error amplifier and the output of the output stage.

15. The voltage regulator of claim 14 wherein the variable impedance device is a FET transistor.

16. The voltage regulator of claim 14, further comprising a sensing circuit having an input connected to the output stage and an output connected to the input of the variable impedance device, the sensing circuit operable to sense the output level of the regulated output voltage.

17. The voltage regulator of claim 14, further comprising a gain stage connected between the error amplifier and the output stage wherein the variable impedance device and the compensation capacitor are connected in series between the input and output of the gain stage, and wherein the variable impedance device, the compensation capacitor and the gain stage together form an integrator amplifier.

18. The voltage regulator of claim 14, further comprising a voltage divider connected between the output stage and the second input of the error amplifier.

* * * * *